United States Patent [19]

Aoki

[11] Patent Number: 4,963,942

[45] Date of Patent: Oct. 16, 1990

[54] FIXING DEVICE HAVING BLOWER FOR SUPPLYING A BLAST OF AIR

[75] Inventor: Fumitaka Aoki, Tokyo, Japan

[73] Assignee: Canon Kabushiki Kaisha, Tokyo, Japan

[21] Appl. No.: 232,170

[22] Filed: Aug. 15, 1988

[30] Foreign Application Priority Data

Aug. 20, 1987 [JP] Japan ..... 62-127053[U]

[51] Int. Cl.[5] ..... G03G 15/20

[52] U.S. Cl. ..... 355/290; 219/216; 355/285; 355/311

[58] Field of Search ..... 219/216, 469; 355/311, 355/312, 282, 285, 289, 290; 432/60

[56] References Cited

U.S. PATENT DOCUMENTS

| | | | |
|---|---|---|---|
| 3,505,497 | 4/1970 | Lawes et al. | 219/216 |
| 3,770,346 | 11/1973 | Jordan | 355/285 |
| 3,857,189 | 12/1974 | Katayama et al. | 432/60 X |
| 3,993,124 | 11/1976 | Mueller | 355/279 X |
| 4,082,137 | 4/1978 | Mueller | 355/290 X |
| 4,309,591 | 1/1982 | Kanoto et al. | 219/216 |
| 4,462,675 | 7/1984 | Moraw et al. | 355/285 |
| 4,571,056 | 2/1986 | Tani et al. | 432/60 X |
| 4,585,325 | 4/1986 | Euler | 355/290 |

FOREIGN PATENT DOCUMENTS

| | | | |
|---|---|---|---|
| 0136779 | 7/1985 | Japan . | |
| 0123484 | 6/1987 | Japan . | |
| 0249874 | 10/1988 | Japan | 355/289 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

An image forming apparatus has a device for forming an unfixed image on a support member, a heat fixing device for fixing the unfixed image by applying heat, and a blower for supplying a blast of air to the heat fixing device. The blast area to the heat fixing device by the blower differs depending on the size of the support member.

12 Claims, 2 Drawing Sheets

FIXING DEVICE HAVING BLOWER FOR SUPPLYING A BLAST OF AIR

BACKGROUND OF THE INVENTION

1. Field of the Invention

This invention relates to an image forming apparatus such as a laser beam printer or a copying apparatus, and in particular to a fixing device for fixing unfixed images by applying heat thereto.

2. Related Background Art

In the latest image forming apparatuses, recording on recording sheets of various sizes such as, for example, formats A3, B4, A4 and B5, is possible. Also, as a device for fixing unfixed toner images formed on recording sheets, it is widely known to apply heat and/or pressure to the recording sheets by a heat plate, a heat roller or the like to thereby melt toner. Particularly, from the requirements for compactness and low power consumption of the apparatus, heat roller fixing devices have come into wide use.

For example, in a heat roller fixing device, the roller length must be the maximum recording paper size, e.g. A3 size or larger. When a recording sheet of small size such as A4 or B5 size is passed between the fixing rollers, as shown in FIG. 3, there is created in the maximum sheet passage width $l_L$ of the fixing rollers a portion through which the recording sheet does not pass (hereinafter referred to as the "sheet non-passage portion")-the portion $l_{L\text{-}S}$ in FIG. 3.

When recording sheets of small size are continuously passed, heat is not taken from the roller surface in the sheet non-passage portion $l_{L\text{-}S}$ by the recording sheets and therefore, the temperature of the roller surface in the sheet non-passage portion $l_{L\text{-}S}$ becomes very high and the temperature difference between the sheet passage portion $l_S$ and the sheet non-passage portion $l_{L\text{-}S}$ sometimes becomes 60 deg. or higher.

In the case as described above, if recording sheets of small size are continuously passed, the temperature of the roller surface in the sheet non-passage portion $l_{L\text{-}S}$ becomes very high. This has led to the following disadvantages:

(1) When a recording sheet of large size is fixing immediately thereafter, high temperature offset is caused in that portion of the sheet which corresponds to the sheet non-passage portion $l_{L\text{-}S}$ and the quality of image is deteriorated;

(2) The diameter of the fixing roller in the sheet non-passage portion $l_{L\text{-}S}$ is thermally expanded and the diameter of the fixing roller becomes axially non-uniform to cause the recording sheet to be wrinkled;

(3) The thermal deterioration of the offset preventing layer on the surface of the fixing roller is expedited to thereby shorten the service life of the fixing roller; and (4) A separating pole which is in contact with the fixing roller to prevent the recording sheet from twining on the fixing roller is deformed by heat.

Now, in order to prevent such conveniences, there is known the technique of making the heat distribution of a heater for heating the fixing roller such that the amount of heat supplied to the sheet non-passage portion $l_{L\text{-}S}$ is smaller than the amount of heat supplied to the sheet passage portion $l_S$ for a recording sheet of small size. However, when a recording sheet of large size is fixated, unsatisfactory fixing such as low temperature offset becomes liable to occur in the portion corresponding to the sheet non-passage portion $l_{L\text{-}S}$ because the amount of heat supplied to the sheet non-passage portion $l_{L\text{-}S}$ is small.

According to the result of the inventor's experiment, it is considered to be difficult to satisfy the fixativeness of a recording sheet of large size and to prevent the temperature rise of the sheet non-passage portion during continuous passage of recording sheets of small size simply by contriving the heat distribution of the heater.

SUMMARY OF THE INVENTION

It is an object of the present invention to provide an image forming apparatus which can accomplish a stable fixing operation irrespective of the size of a support member supporting an unfixed image thereon.

It is another object of the present invention to provide an image forming apparatus in which the sheet non-passage portion in a heat fixing device will not rise in temperature even if the fixing operation is continuously repeated.

Further objects of the present invention will become apparent from the following detailed description.

DESCRIPTION OF THE PREFERRED EMBODIMENTS

Figure 1:
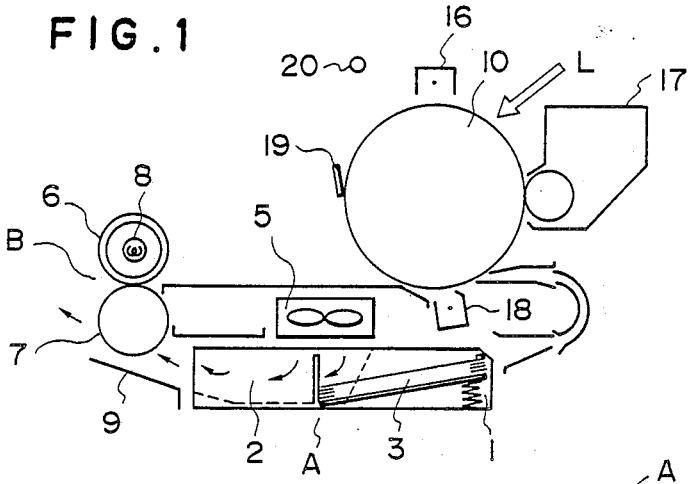
FIG. 1 is a simple cross-sectional view of an image forming apparatus according to the present invention.

Some embodiments of the present invention will hereinafter be described with reference to the drawings. In the drawings, functionally similar members are given similar reference numerals.

In FIG. 1, the reference numeral 10 designates a photosensitive drum, the reference numeral 16 denotes a charger for uniformly charging the surface of the photosensitive drum, the letter L designates an image light, the reference numeral 17 denotes a developing device, the reference numeral 19 designates a cleaner, and the reference numeral 20 denotes a pre-exposure lamp.

An unfixed toner image formed on the photosensitive drum 10 is transferred to recording sheet 3 contained in a sheet supply cassette A by the action of a transfer charger 18. The recording sheet supporting this unfixed toner image thereon is fixed by a fixing device B. The fixing device B has a heating roller 6 for fixing provided with a heater 8 therein, and a back-up roller 7 opposed to the heating roller 6 and forming a nip therewith.

The reference numeral 5 designates a cooling fan. The air blown by the cooling fan 5 passes through the cassette A and is blown against the back-up roller 7. The reference numeral 9 denotes a blast guide for directing the cooling air to the back-up roller 7.

Figure 2:
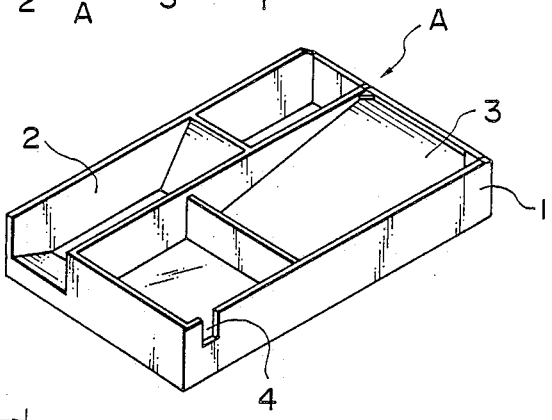
FIG. 2 is a perspective view of a cassette according to an embodiment of the present invention.
Figure 3:
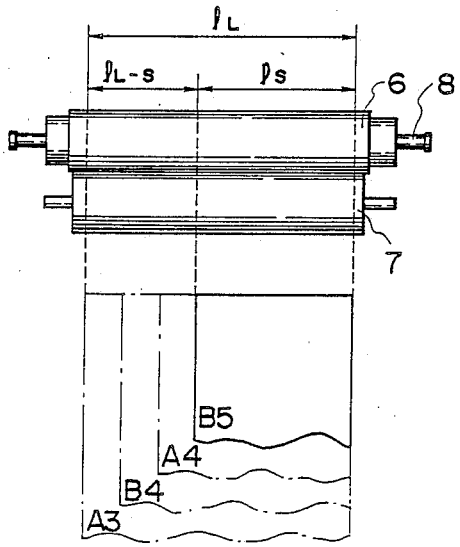
FIG. 3 is a view for illustrating the present invention.

Referring to FIG. 2 which is a perspective view of the cassette A shown in FIG. 1, the reference numeral 1 designates an outer cassette housing, the reference numeral 2 denotes a blast path provided at a location corresponding to the sheet non-passage portion in the outer cassette housing, and the reference numeral 4 designates an air exhaust hole.

A plurality of kinds of such cassettes A are provided corresponding to the sizes of recording sheet. However, these several kinds of cassettes are substantially similar in configuration in order to improve the reliability with which they are mounted to the image forming apparatus and further, the positional accuracy thereof relative to the apparatus, and are provided with partitions corresponding to the sizes of recording sheet contained therein, whereby they correspond to various sizes of recording sheet.

Accordingly, in cassettes for large sizes (not shown), the excess space in the outer cassette housing which does not contain the recording sheet is small. In cassettes for small sizes, as shown in FIG. 2, the excess space which does not contain the recording sheet is large. This excess space includes a portion corresponding to the sheet non-passage portion.

Also, the excess space in a direction orthogonal to the direction of conveyance of the recording sheet substantially coincides, with the sheet non-passage portion of the pair of fixing rollers. The aforementioned blast path 2 for passing the cooling air therethrough is provided in a portion corresponding to this sheet non-passage portion of the cassette.

As previously described, the cooling air supplied into the cassette by the cooling fan 5 passes through the blast path 2, and is supplied to the fixing portion by the blast guide 9 to cool the sheet non-passage portion $l_{L-S}$ of the back-up roller 7, whereafter the cooling air is discharged out of the apparatus.

The cooling air supplied to within the width of the recording sheet in a direction orthogonal to the direction of conveyance of the recording sheet in the cassette escapes through the air exhaust hole 4, whereby no air is flown against the back-up roller 7.

In the present embodiment, the blast width of the cooling fan 5 is provided so as to correspond to the sheet non-passage portion $l_{L-S}$ when the size of the sheet contained in the cassette is the smallest size. Therefore, the cassette containing recording sheet of the smallest size does not require the air exhaust hole and also, the width of the cooling fan 5 can be made small.

Thus, the excess space in the cassette in the lengthwise direction of the fixing roller (the direction orthogonal to the direction of conveyance of the recording sheet) provides the blast path to the fixing roller, whereby in a cassette having a large sheet non-passage portion, a great deal of air is blown over a great width and in a cassette having a small sheet non-passage portion, a quantity of cooling air corresponding to the small width is supplied to the fixing roller.

In the cassette for recording sheet of the largest size, the blast path 2 is, absent, and little or no air is blown against the fixing portion and the air is discharged through the air exhaust hole.

According to the present embodiment, the sheet passage portion is hardly cooled and the sheet non-passage portion is sufficiently cooled and therefore, the sheet non-passage portion will not rise in temperature even if the fixing operation for recording sheet of small size is continuously repeated. Also, the larger is the sheet non-passage portion, the greater is the quantity of blast and therefore, the effect of preventing the temperature rise of the sheet non-passage portion is further enhanced. Also, the cooling air is applied to the back-up roller 7 urged against the heating roller 6 and little or no air is blown against the heating roller 6. That is, by cooling the sheet non-passage portion of the back-up roller 7, the temperature rise of the sheet non-passage portion of the heating roller 6 which is in contact with the back-up roller is prevented. When strong cooling air is directly supplied to the heating roller 6, there may be caused irregularity of fixing by sudden heat radiation, but in the present embodiment, this problem can also preferably be solved.

Further, the quantity of air blown by the cooling fan may be changed by the difference between the sheet non-passage portions to thereby prevent the temperature rise of the sheet non-passage portions. According to the present embodiment, however, cooling air of a quantity and width corresponding to the size of recording sheet is supplied to the back-up roller 7 simply by changing the cassette to cool the back-up roller properly. Also, the rotation of the cooling fan 5 may take place only during the image forming operation.

According to an experiment using the electrophotographic apparatus of the present invention, even if recording sheets of various small sizes were continuously fixed, the temperature difference on the roller surface between the sheet passage portion $l_S$ and the sheet non-passage portion $l_{L-S}$ was 30 deg. or less. Also, even if a recording sheet of large size was fixed immediately after the continuous fixation of recording sheets of small size, the phenomenon of high temperature offset did not occur nor did wrinkling occur. As regards also the fixativeness, there was obtained a fully satisfactory result.

Figure 4:
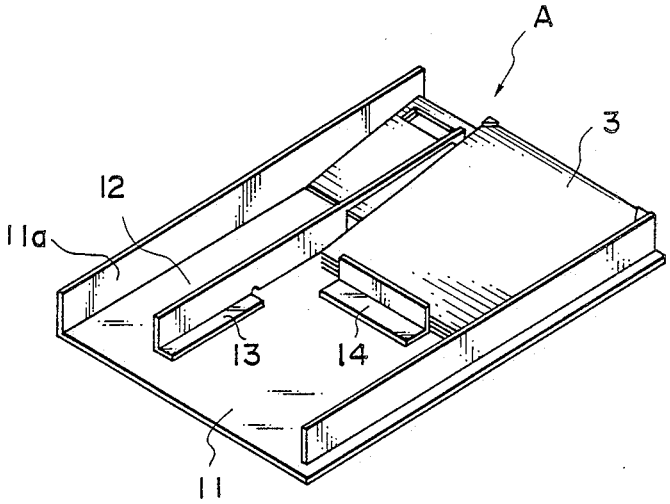
FIG. 4 is a perspective view of a tray according to another embodiment of the present invention.

FIG. 4 shows a second embodiment of the present invention in which recording sheet is contained not only in a cassette but also in a tray contained in the apparatus.

In FIG. 4, the reference numeral 11 designates a tray bottom plate, and the reference numeral 13 denotes a movable side plate for controlling the end portion of the recording sheet in the lengthwise direction of the fixing roller. The reference numeral 14 designates a movable back plate for controlling the end portion of the recording sheet in the direction of conveyance. In the tray of this embodiment, the side plate 13 and the back plate 14 are moved, whereby recording sheets 3 of various sizes are contained properly. Also, a blast path 12 is formed by the side plate 13 and the side portion 11*a* of the tray bottom plate, whereby there can be obtained an effect similar to that of embodiment of the FIG. 1.

Thus, in the present embodiment shown in FIG. 4, the blast width is automatically changed corresponding to the sheet non-passage portion by the movement of the side plate 13 provided along the direction of conveyance of the recording sheet.

Figure 5:
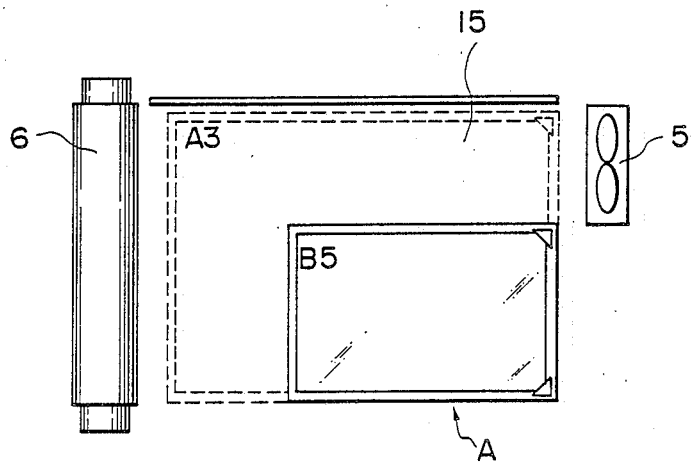
FIG. 5 is a top plan view for illustrating still another embodiment of the present invention.

Still another embodiment of the present invention is shown in FIG. 5 which is a schematic top plan view in a case where the outer cassette housing is configured in accordance with each size of recording sheet and the excess space which does not contain recording sheet in the outer cassette housing is small.

In this case, no blast path is provided in the cassette, but there is a space 15 between the cassette mounting portion of the image forming apparatus and the outer cassette housing and a blast path can be provided therein. That is, the blast path formed by the cassette may be inside or outside of the cassette A.

Thus, in the present embodiment, the sheet non-passage portion of the fixing roller is heated due to the difference between the sheet passage areas for recording sheets of large size and for recording sheets of small size and therefore, the space corresponding to the sheet non-passage portion of the cassette or the tray containing the recording sheet therein to cool the sheet non-passage portion, that is, the space created by the difference between the large size and the small size, can be provided as the blast path for the cooling air. Accordingly, it is not necessary to provide a blast mechanism specially for each size of sheet.

While the embodiments of the present invention have been described with respect to the one-side standard paper passage in which the sheet is conveyed with one side and one end thereof as the standard, the present invention is also of course applicable to the center standard sheet passage in which the sheet is conveyed with the center thereof as the standard.

Although the embodiments of the present invention have been described above, the present invention is not restricted to the above-described embodiments. but permits all modifications within the technical concept of the present invention.

What is claimed is:

1. An image forming apparatus having:

containing means for containing therein support members;

means for forming unfixed images on the support members;

heat fixing means for fixing the unfixed images by applying heat thereto; and blower means for supplying a blast of air to said heat fixing means;

a portion of said containing means forming a part of the blast path for the air from said blower means.

2. An image forming apparatus according to claim 1, wherein said containing means for said support members is a cassette.

3. An image forming apparatus according to claim 1, wherein said containing means for said support members is a tray.

4. An image forming apparatus according to claim 1, wherein said heat fixing means has a pair of rollers having a heat roller heated by a heating source, and said blower means supplies a blast of air to the sheet non-passage portion of said pair of rollers.

5. An image forming apparatus according to claim 1, wherein said containing means has a wall portion provided along the direction of conveyance of said support members, and said wall portion constitutes a part of the blast path.

6. An image forming apparatus according to claim 1, wherein a plurality of containing means corresponding to the sizes of the support members are usable, and the blast area to said heat fixating means differs depending on the difference in size between said containing means.

7. An image forming apparatus having:

containing means for containing therein support members, said containing means being capable of containing support members of a plurality of sizes;

means for forming unfixed images on the support members;

heat fixing means for fixing the unfixed images by applying heat thereto; and blower means for supplying a blast of air to said heat fixing means;

said containing means having moving members corresponding to the sizes of the support members, said moving members constituting a part of the blast path for the air from said blower means.

8. An image forming apparatus according to claim 7, wherein said moving members control the end portion of the support members in a direction orthogonal to the direction of conveyance thereof.

9. An image forming apparatus according to claim 7, wherein said containing means for said support members is a cassette.

10. An image forming apparatus according to claim 7, wherein said containing means for said support members is a tray.

11. An image forming apparatus according to claim 7, wherein said heat fixing means has a pair of rollers having a heat roller heated by a heating source, and said blower means supplies a blast of air to the sheet non-passage portion of said pair of rollers.

12. An image forming apparatus according to claim 7, wherein said moving members are provided along the direction of conveyance of the support members.

* * * * *

UNITED STATES PATENT AND TRADEMARK OFFICE

CERTIFICATE OF CORRECTION

PATENT NO. : 4,963,942

DATED : October 16, 1990

INVENTOR(S) : Fumitaka Aoki

It is certified that error appears in the above-identified patent and that said Letters Patent is hereby corrected as shown below:

COLUMN 1:

Line 16, "known" should read --practised--.

Line 44, "fixing" should read --fixed--.

COLUMN 3:

Line 55, "is," should read --is--.

Signed and Sealed this

Second Day of June, 1992

*Attest:*

DOUGLAS B. COMER

*Attesting Officer*

*Acting Commissioner of Patents and Trademarks*